US005190319A

United States Patent [19]

Sandler

[11] Patent Number: 5,190,319

[45] Date of Patent: Mar. 2, 1993

[54] TICKET FOR DESIGNATING VEHICLE PARKING LOCATION

[76] Inventor: Ronald A. Sandler, 1320 N. State Pkwy., Chicago, Ill. 60610

[21] Appl. No.: 769,444

[22] Filed: Oct. 1, 1991

[51] Int. Cl.[5] ..... B42D 15/00

[52] U.S. Cl. ..... 283/102; 283/114; 283/70; 283/74

[58] Field of Search ..... 283/70, 102, 67, 117, 283/114, 74

[56] References Cited

U.S. PATENT DOCUMENTS 4,881,758 11/1989 Ben-David ..... 283/102

*Primary Examiner*—Paul A. Bell

*Attorney, Agent, or Firm*—Jones, Day, Reavis & Pogue

[57] ABSTRACT

A device for uniquely recording a vehicle parking lot location including a printed card identifying a parking location having a plurality of parking areas. A like plurality of characters are on the printed card with at least one character representing a corresponding one of the plurality of parking areas. A friable removable mask covering is associated with each character such that the friable mask is easily removed from over the character designating a particular parking area in which a vehicle is parked.

2 Claims, 1 Drawing Sheet

TICKET FOR DESIGNATING VEHICLE PARKING LOCATION

FIELD OF THE INVENTION

The present invention relates generally to record-keeping apparatus for determining where a vehicle is parked and in particular to a printed card identifying a plurality of parking locations in a particular parking facility and a friable removable mask covering associated with each location such that the friable mask is easily removed from over the area designating a particular parking location where a vehicle is parked.

BACKGROUND OF THE INVENTION

Because of the great number of vehicles that are used in today's society, multiple floor or large lot self-parking facilities are numerous. There are buildings having multiple floors, both below and above the ground, that serve as parking areas for tenants of buildings. There are large parking lots associated with shopping malls and airports. On many occasions, with a large mall, there are parking lots on all sides of the mall with different areas of each parking lot being designated in a variety of ways such as, for example, colors, animals, and other indicia. Thus, if one parks in a lot with an elephant on a light pole in the lot, one tries to remember that he or she is parked in the elephant parking lot. Of course, it may be difficult to remember on which side of the mall the elephant lot is located.

Almost everyone who has occasion to self-park an automobile on a regular basis has had the frustrating experience of being unable to recall the specific location or floor where the automobile was parked. In a building, this may mean going from floor to floor attempting to locate the parked automobile or vehicle. In other cases, it may mean going through a large parking lot area surrounding a mall to try to find the vehicle. The fact that the floors of buildings have numbers and parking lot areas may be designated in a variety of ways, such as by animals or colors, does not always solve the problem and it is still not uncommon to forget the floor or the designated area in which the vehicle is parked. Different methods have been tried in the past to assist in remembering the floor or area where the vehicle is parked. A multilevel parking facility is shown in U.S. Pat. No. 4,674,937 in which different floors are designated by audible sounds with a visual display identifying the audible sound. Again, though, some memory is required to recall the floor on which the vehicle is parked. Other parking facility tickets may have a grid for the driver to mark the ticket — but often a marking instrument is not available.

The present invention, by allowing the driver to use his automobile key as the instrument, in conjunction with the new ticket, provides a convenient way to designate the vehicle's location in a precise and positive manner.

The present invention solves the problem of the prior art by providing a parking ticket in the form of a printed card identifying a plurality of parking locations in a particular parking facility and a friable removable mask covering associated with each location such that the friable mask is easily removed over the area designating a particular parking location where a vehicle is parked. The printed card includes a plurality of characters with at least one character representing each one of the plurality of the designated parking locations. For example, the numerals 1–10 may be used to designate floors in a 10-story parking garage. Various animals may indicate a particular section of a parking lot of a mall in which a vehicle is parked. A cross grid may be used to designate the aisle of a floor, e.g., A-1; B-3. Associated with each character is the friable removable mask covering (such as shown in U.S. Pat. No. 4,752,087 and used for record-keeping purposes) such that the friable mask is easily removed from over the character or area designating the vehicle location. For example, if one were parked on a fifth floor, row B, of the building, one would merely need to scratch the friable mask covering associated with the numeral five and the letter "B" to designate that the vehicle is parked on the fifth floor in row B.

Clearly, any unique pictorial representation could be used to designate a particular parking location. If, for instance, a parking lot surrounds a mall, a particular side of the mall could be designated by a first character such as a letter E, N, S or W designating compass directions or numerals that would correspond to numerals on various inside walls of the mall or any other type of indicia that represents a particular side of the mall. For a particular area on the particular side of the building, a second type of indicia could be used. For instance, the friable removable mask coverings could be in rows and columns with a first indicia associated with each row to indicate a side of the building and a second indicia associated with each column to indicate a particular parking lot on that side of the building. Thus by removing the friable mask covering associated with a particular row and column intersection, one would positively designate the particular side of the building and the particular area on that side of the building in which the vehicle is parked.

The use of the friable removable mask covering is advantageous because one can use the car ignition key — available when the car is parked, or a fingernail, a coin or any such item to remove the mask covering even though one may not have with them a marking instrument such as a pencil or a pen.

Thus, it is an object of the present invention to provide a device for easily recording a vehicle parking location.

It is also an object of the present invention to provide a device for easily recording a vehicle parking location without the use of a marking instrument such as a pen or pencil.

It is still another object of the present invention to provide a device for easily recording a vehicle parking location including a printed card on which a plurality of characters or spaces each representing any one of a plurality of parking locations and a friable removable mask covering associated with each character or space such that the friable mask is easily removed from over the character or space designating the particular parking location.

SUMMARY OF THE INVENTION

The present invention relates to a device for easily recording a vehicle parking location comprising a printed card identifying a plurality of parking locations at the parking facility, at least one character or space representing a corresponding one of the plurality of parking locations, and a friable removable mask covering associated with each character or space such that the friable mask is easily removed from over the character or space designating the particular parking location where a vehicle is parked.

The invention also relates to a method for easily recording a vehicle parking location comprising the steps of utilizing a plurality of characters on a card such that each character represents one of a plurality of parking areas and associating a friable removable mask covering with each character such that the friable mask is easily removed to designate a particular parking area where a vehicle is parked.

BRIEF DESCRIPTION OF THE DRAWINGS

These and other advantages of the present invention will be more readily understood when taken in conjunction with the accompanying detailed description and the attached drawings in which like numerals represent like elements and in which.

DETAILED DESCRIPTION OF THE DRAWINGS

Figure 1:
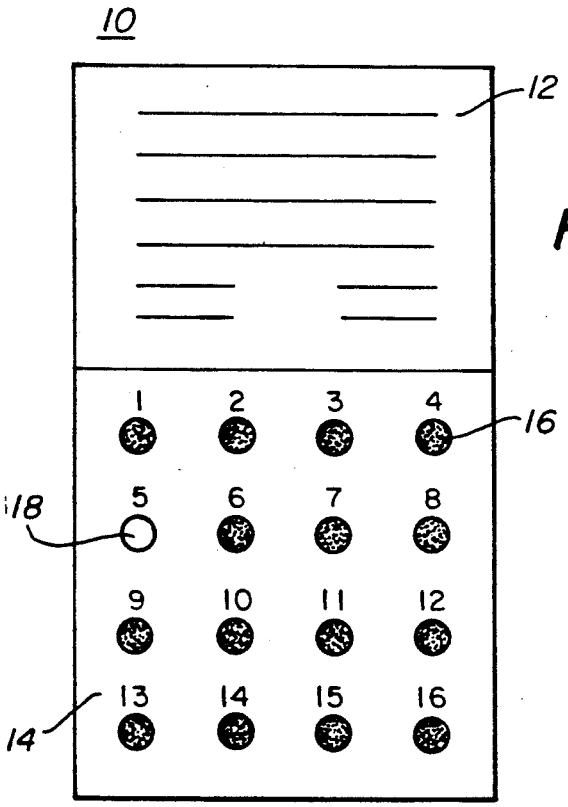
FIG. 1 is a plan view of a first embodiment of a device for easily recording a vehicle parking location.

FIG. 1 is a plan view of a ticket or printed card for easily self-recording a vehicle parking location. The card 10 has a first area 12 which may have indicia to identify a particular parking location. The area 14 may have a plurality of numerals representing a particular floor or location in which a vehicle may be parked. In FIG. 1, the numerals range from 1 to 16. A friable removable mask covering 16 is associated with each of the numerals 1–16. If, for example, one parks his vehicle on the fifth floor, he simply uses a fingernail, coin, car key or other object to remove the friable covering associated with the numeral 5 as illustrated by the numeral 18. When the individual seeks to return to the parking place, he or she simply notes that the friable mask covering associated with the numeral 5 is removed and recalls that the vehicle is on the fifth floor. The numerals 1–16 could, of course, be other indicia such as colors, animals and the like. Further, the friable mask 16 could be over a numeral instead of beside it. The indicia would show through the friable mask or covering 16.

Figure 2:
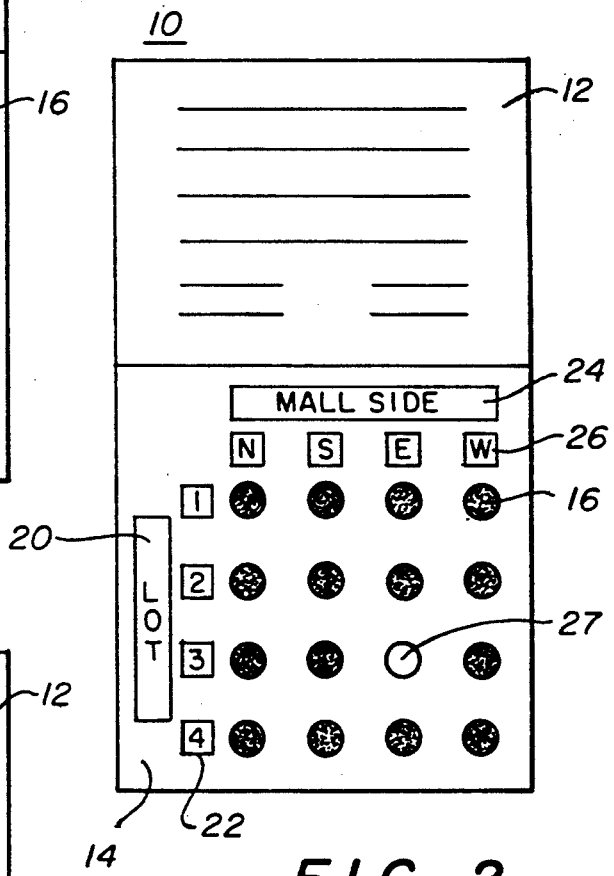
FIG. 2 is a plan view of a first alternate embodiment of a device for easily recording a vehicle parking location.

FIG. 2 is a plan view of an alternate type of device for easily recording a vehicle parking location. The device 10 again may be a printed card having a first area 12 identifying a particular parking location. Associated with the card 10 is an area 14 having rows and columns of friable removable mask covering areas. Associated with each row may be corresponding indicia 22 such as numerals 1–4. These may represent a particular parking area as shown by the numeral 20. Associated with each column may be a designation 24 for a floor, mall or aisle. These columns may have indicia 26 such as, for example, N, S, E, W, representing north, south, east and west sides of a particular mall. If one happens to park the automobile on the east side of the mall in lot 3, one simply removes the friable mask covering as designated by the numeral 27, which is at the intersection of column E and row 3. Thus, the individual then recalls that the vehicle was parked on lot 3 on the east side of the mall. Again, it is to be understood that the indicia 22 and the direction-indicating letters 26 are for examples only and could be combinations of colors, animal indicia and the like.

Figure 3:
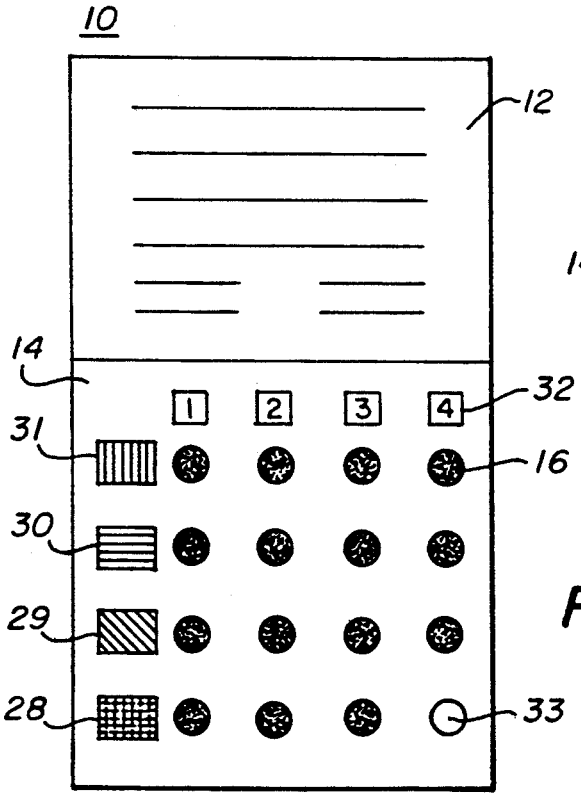
FIG. 3 is a second alternate embodiment of a device for easily recording a vehicle parking location.

FIG. 3 is a plan view of a third embodiment of a printed card 10 having indicia in area 12 to identify the parking facility and again rows and columns of friable removable mask coverings with colors 28, 29, 30 and 31 associated with the rows and the numerals 1–4 associated with the columns. Again, if the color 28 is red designating its particular area or floor of a parking location and if the numeral 4 designates the particular aisle or the like, one merely removes the friable mask covering 33 at the intersection of column 4 and the red color 28. Again, the numerals designated 1–4 could be other indicia instead of numerals.

The novel method for easily recording a vehicle parking location comprises the steps of printing indicia on a card to identify a plurality of parking areas in a parking location, printing a plurality of characters on the card, at least one character representing one of the plurality of parking areas, and associating a friable removable mask covering with each character such that the friable mask is easily removed from over the character or space designating a particular parking location in which the vehicle is parked. For purposes hereof, the word "character" actually may be a blank or unprinted portion of the card in a particular grid. Thus, for example, removing the friable mask for floor 5, row 3, may leave an exposed area on the card that also acts as the vehicle location. In this case, the preprinted grid serves as the location finder — regardless of whether there is anything printed below the mask that is removed.

Thus, there has been disclosed a novel device for easily recording a vehicle parking location. The device may be, for example, a printed card having indicia thereon identifying a parking location having a plurality of parking locations. A friable removable mask covering is associated with each parking location such that the friable mask is easily removed over the area designating the particular parking location in which the vehicle is parked. The friable mask covering is advantageous in that it does not require any particular type of instrument to remove it. It can be removed with a car key, a coin, a fingernail, a sharp pointed object, and the like.

While the invention has been shown and described with respect to a particular embodiment thereof, this is for the purpose of illustration rather than limitation; other variations and modifications of the specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

I claim:

1. A device for easily recording a vehicle parking location in a parking facility comprising:

a printed card having indicia in a plurality of rows and columns for identifying a parking location;

a first unique pictorial representation for each row of indicia to represent one of a first plurality of unique parking features identifying where the vehicle is parked such as a parking lot on one of the sides of a building;

a second unique pictorial representation for each column of indicia to represent one of a second plurality of unique parking features identifying where the vehicle is parked such as a particular area in the parking lot on one of the sides of a building designated by one of the first row indicia; and a friable removable mask covering associated with each indicia in the rows and columns such that the friable mask is easily removed from the location at the intersection of a row wherein one of the first unique parking features is represented by one of the first unique pictorial representations and a column wherein one of the second unique parking features is represented by one of the second unique pictorial representations to specifically identify the vehicle parking location.

2. A method for easily recording a vehicle parking location in a parking facility comprising the steps of:

printing a card having indicia in a plurality or rows and columns for identifying a parking location;

providing a first unique pictorial representation for each row of indicia to represent one of a first plurality of unique parking features identifying where the vehicle is parked such as a parking lot on one of the sides of a building;

providing a second unique pictorial representation for each column of indicia to represent one of a second plurality of unique parking features identifying where the vehicle is parked such as a particular area in the parking lot on one of the sides of a building designated by one of the first row indicia; and associating a friable removable mask with each indicia in the rows and columns such that the friable mask is easily removed from the location at the intersection of a row wherein one of the first unique parking features is represented by one of the first unique pictorial representations and a column wherein one of the second unique parking features is represented by one of the second unique pictorial representations to identify the vehicle parking location.

* * * * *